US010926162B2

(12) United States Patent
Han

(10) Patent No.: US 10,926,162 B2
(45) Date of Patent: Feb. 23, 2021

(54) FOUR-WHEEL SKATEBOARD AND CONTROL METHOD THEREOF

(71) Applicant: Shenzhen Dongboshi Technology Co., LTD., Shenzhen (CN)

(72) Inventor: Xiaodong Han, Shenzhen (CN)

(73) Assignee: SHENZHEN DONGBOSHI TECHNOLOGY CO., LTD., Shenzhen (CN)

( * ) Notice: Subject to any disclaimer, the term of this patent is extended or adjusted under 35 U.S.C. 154(b) by 0 days.

(21) Appl. No.: 16/526,917

(22) Filed: Jul. 30, 2019

(65) Prior Publication Data

US 2020/0238158 A1 Jul. 30, 2020

(30) Foreign Application Priority Data

Jan. 30, 2019 (CN) ..... 201910092541.4

(51) Int. Cl.

| | |
|---|---|
| ***A63C 17/00*** | (2006.01) |
| ***A63C 17/12*** | (2006.01) |
| ***A63C 17/01*** | (2006.01) |
| ***A63C 17/14*** | (2006.01) |

(52) U.S. Cl.

CPC ..... *A63C 17/12* (2013.01); *A63C 17/01* (2013.01); *A63C 17/14* (2013.01); *A63C 2203/12* (2013.01)

(58) Field of Classification Search

CPC ..... A63C 17/015; A63C 17/12; A63C 17/26; A63C 17/01; A63C 17/14

See application file for complete search history.

(56) References Cited

U.S. PATENT DOCUMENTS

| | | | | |
|---|---|---|---|---|
| 4,740,009 A * | 4/1988 | Hoelzl | A63C 5/07 | 280/602 |
| 5,498,017 A * | 3/1996 | Rohrmoser | A63C 9/0802 | 280/612 |
| 5,893,425 A * | 4/1999 | Finkle | A63C 17/01 | 180/180 |
| 6,650,357 B1 * | 11/2003 | Richardson | G01J 3/10 | 348/80 |
| 7,145,787 B2 * | 12/2006 | Lanni | H02M 3/3372 | 363/80 |
| 7,274,602 B2 * | 9/2007 | Arakawa | G11C 5/145 | 365/189.09 |

(Continued)

*Primary Examiner* — Hau V Phan

(57) ABSTRACT

A method of controlling a four-wheel skateboard, the method comprising: applying a load on an induction switch of the four-wheel skateboard, the induction switch starting a power switch of the four-wheel skateboard; driving the four-wheel skateboard to slide by the assistance of the load; controlling and starting a motor, by a controller of the four-wheel skateboard, to drive the four-wheel skateboard to slide; and taking the load off from the induction switch of the four-wheel skateboard and the induction switch shutting down the power switch of the four-wheel skateboard. The four-wheel skateboard relies on the load-assisted driving, not entirely on the driving force of the motor, so that the four-wheel skateboard consumes less electricity for sliding the same distance as conventional skateboards, requires relatively small amounts of lithium-ion batteries, and requires not too large battery capacity and not too high voltage, thus reducing the manufacturing cost of the four-wheel skateboard.

12 Claims, 3 Drawing Sheets

(56) References Cited

U.S. PATENT DOCUMENTS

| | | | | |
|---|---|---|---|---|
| 8,373,310 | B2 * | 2/2013 | Baarman | H02J 50/40 307/104 |
| 9,526,971 | B1 * | 12/2016 | Barden | A63C 9/0802 |
| 10,044,229 | B2 * | 8/2018 | Partovi | H02J 50/005 |
| 10,146,980 | B2 * | 12/2018 | Moyerman | G06K 9/00 |
| 10,173,549 | B2 * | 1/2019 | Melvin | H02K 5/04 |
| 2010/0001484 | A1 * | 1/2010 | Cole | A63C 17/12 280/87.042 |
| 2010/0148483 | A1 * | 6/2010 | Kopp | A63C 17/26 280/809 |
| 2015/0306511 | A1 * | 10/2015 | Norman | A63H 29/22 446/465 |
| 2016/0184690 | A1 * | 6/2016 | Aders | A63C 17/012 180/20 |
| 2016/0195246 | A1 * | 7/2016 | Carattini | A63C 17/26 362/486 |
| 2017/0252638 | A1 * | 9/2017 | Ulmen | A63C 17/015 |
| 2018/0257486 | A1 * | 9/2018 | Noble Nava | B60B 19/12 |

* cited by examiner

FOUR-WHEEL SKATEBOARD AND CONTROL METHOD THEREOF

CROSS REFERENCE TO RELATED APPLICATIONS

This non-provisional patent application claims priority under 35 U.S.C. § 119 of a China Patent application No. 201910092541.4 filed on Jan. 30, 2019. The applications are incorporated herein by reference.

TECHNICAL FIELD

The present disclosure relates to the field of four-wheel skateboards, and in particular to a four-wheel skateboard and a control method thereof.

BACKGROUND

There are two control modes of electric four-wheel skateboards in the current market: body-sensing control mode and remote control mode. The acceleration, deceleration and braking of the four-wheel skateboards can be controlled by an inductor or remote.

However, the drive of these kind of four-wheel skateboards involves complex control systems and too many batteries for supplying power, thus increasing the manufacturing costs thereof.

SUMMARY

To solve the abovementioned problems that the drive of conventional four-wheel skateboards involves complex control systems and too many batteries thus leading to relatively high manufacturing costs, one objective of the present disclosure is to provide an improved four-wheel skateboard and a control method thereof.

The present disclosure adopts the following technical schemes.

Disclosed is a method of controlling a four-wheel skateboard, the method comprising:

applying a load on an induction switch of the four-wheel skateboard, the induction switch starting a power switch of the four-wheel skateboard;

driving the four-wheel skateboard to slide by the assistance of the load;

controlling and starting a motor, by a controller of the four-wheel skateboard, to drive the four-wheel skateboard to slide; and taking the load off from the induction switch of the four-wheel skateboard and the induction switch shutting down the power switch of the four-wheel skateboard.

As an improvement, controlling and starting a motor to drive the four-wheel skateboard to slide comprises: when the four-wheel skateboard is driven by the load to slide, a driving wheel, in which the motor is built-in, of the four-wheel skateboard rotates with the four-wheel skateboard, the controller detects the rotation of the driving wheel and controls the motor to drive the four-wheel skateboard to slide.

As an improvement, the controller detects the rotation of the driving wheel and controls the motor to drive the four-wheel skateboard to slide for between 5 and 100 seconds.

As an improvement, the controller detects the rotation of the driving wheel and controls the motor to drive the four-wheel skateboard to slide for between 10 and 20 seconds.

As an improvement, the continuous sliding of the four-wheel skateboard is achieved as follows: the four-wheel skateboard is alternately driven by the load and by the motor.

As an improvement, the method further comprises speeding up or braking the four-wheel skateboard by a remote.

The disclosure further provides a four-wheel skateboard controlled by the aforesaid method, the four-wheel skateboard comprising a pedal, a driving wheel, driven wheels, an induction switch, a power supply, a controller, and a motor. The induction switch, the power supply, and the motor are electrically connected to the controller; the pedal comprises a pedal surface; the induction switch is embedded in the pedal from the pedal surface; the power supply and the controller are disposed in the pedal; the driving wheel and the driven wheels are arranged at a bottom of the pedal; the motor is disposed in the driving wheel.

As an improvement, the pedal comprises a bottom shell and a cover plate mounted on and cooperating with the bottom shell to form an inner cavity; the driving wheel and the driven wheels are arranged on a bottom of the bottom shell; the controller and the power supply are disposed in the inner cavity; the cover plate comprises a first surface away from the bottom shell and a second surface facing the bottom shell, and the first surface acts as the pedal surface.

As an improvement, the four-wheel skateboard applies one driving wheel, one motor, and three driven wheels; two of the three driven wheels are disposed on a front end of the pedal, and the one driving wheel and one driven wheel are disposed on a rear end of the pedal.

As an improvement, the three driven wheels comprises a first driven wheel, a second driven wheel, and a third driven wheel; the first driven wheel and the third driven wheel are disposed on the front end of the pedal via a first bridge frame; the one driving wheel and the third driven wheel are disposed on the rear end of the pedal via a second bridge frame.

As an improvement, the power supply comprises a plurality of 3.7 V lithium-ion batteries connected in series.

As an improvement, the four-wheel skateboard further comprises a remote in communication with the controller for speeding up or braking the four-wheel skateboard.

Advantages of the four-wheel skateboard and the control method thereof according to embodiments of the disclosure are summarized as follows.

Through the load-assisted driving, the controller in the four-wheel skateboard controls the motor to start, and the motor acquires an initial speed to drive the four-wheel skateboard to slide. The four-wheel skateboard relies on the load-assisted driving, not entirely on the driving force of the motor, so that the four-wheel skateboard consumes less electricity for sliding the same distance as conventional four-wheel skateboards, requires relatively small amounts of lithium-ion batteries, requires not too large battery capacity and not too high voltage, and no body sense or remote control is involved, thus reducing the manufacturing cost of the four-wheel skateboard.

Symbols: 1. Four-wheel skateboard; 10. Induction switch; 20. Power supply; 21. Lithium-ion battery; 30. Controller;

40. Driving wheel; 50. Pedal; 51; Pedal surface; 52. Bottom shell; 53. Cover plate; 60. Driven wheel; 61. First driven wheel; 62. Second driven wheel; 63. Third driven wheel; 70. Bridge frame.

DETAILED DESCRIPTION OF THE PREFERRED EMBODIMENTS

Below, embodiments of the disclosure will be described in detail with reference to the drawings. It should be noted that the figures are illustrative rather than limiting. The figures are not drawn to scale, only for illustrating every aspect of the described embodiments, and do not limit the scope of the present disclosure.

Figure 1:
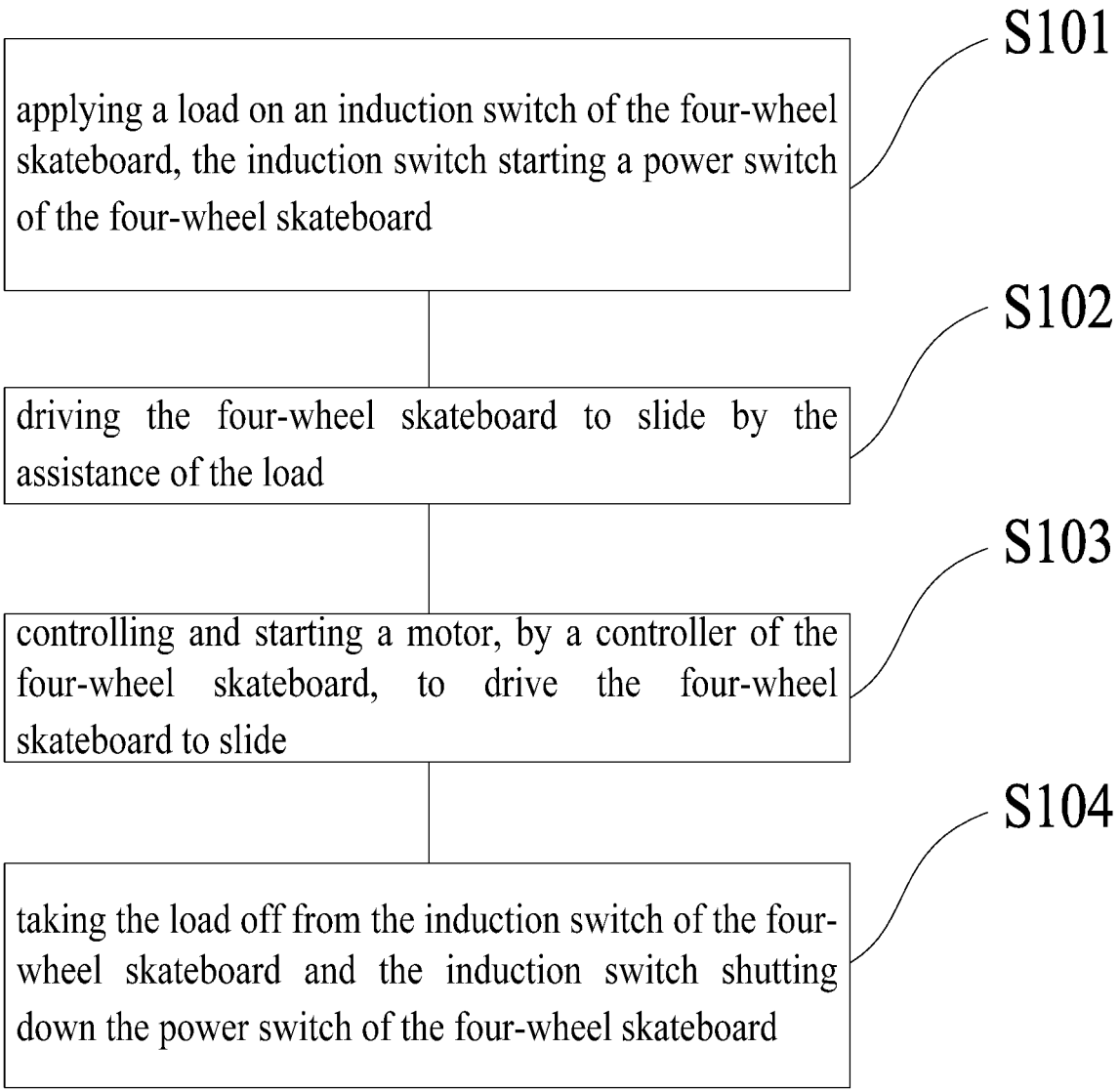
FIG. 1 is a flow chart of a method of controlling a four-wheel skateboard of the disclosure.
Figure 2:
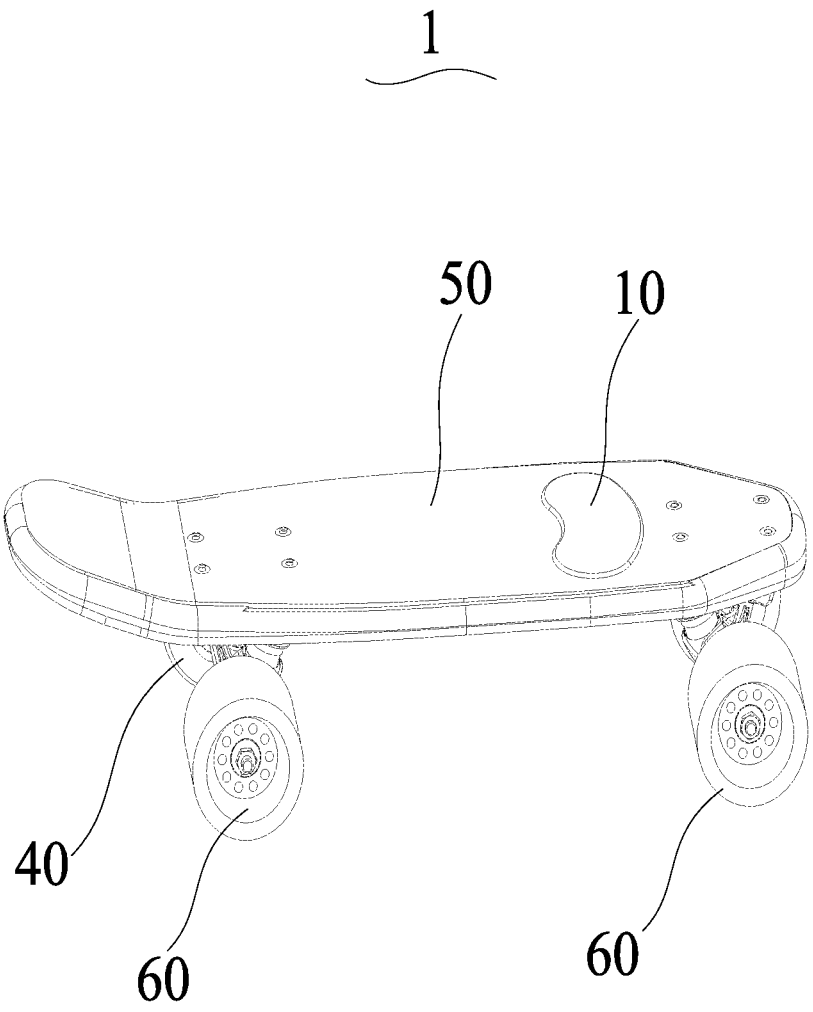
FIG. 2 is a schematic diagram of the four-wheel skateboard of the disclosure.
Figure 3:
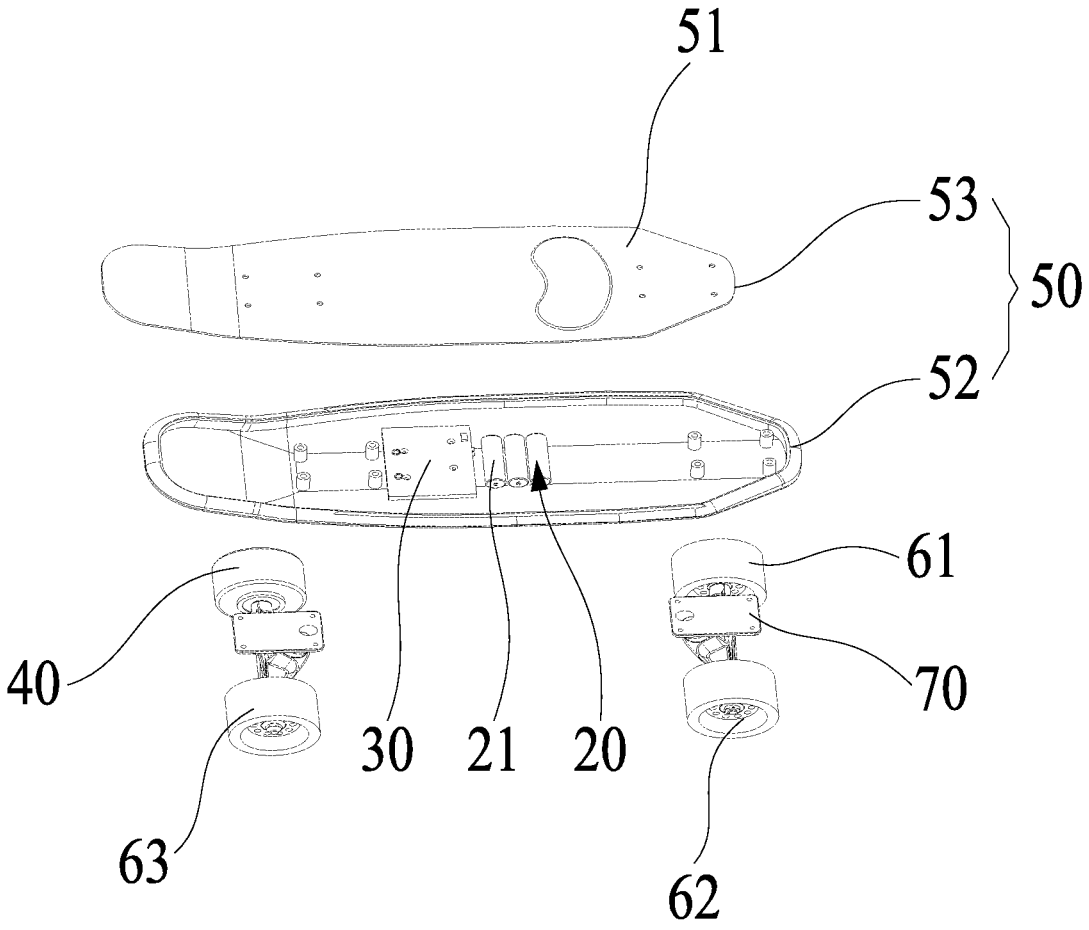
FIG. 3 is an exploded view of the four-wheel skateboard of the disclosure.

Refer to FIGS. 1-3, the disclosure provides a method of controlling a four-wheel skateboard, the method comprising:

S101. applying a load to a four-wheel skateboard 1 by a human foot stepping on the four-wheel skateboard 1, applying the load on an induction switch 10 of the four-wheel skateboard, the induction switch 10 switching on a power switch of the four-wheel skateboard 1, the four-wheel skateboard 1 being automatically started and staying in a static state;

S102. driving, by the load, the four-wheel skateboard 1 to slide, so that the four-wheel skateboard 1 acquires an initial velocity and starts to slide. In the present embodiment, the driving force provided by the load results from the human' sliding, and the human' sliding is generated by others' pushing and/or the human's feet's thrust;

S103. When the controller 30 detects the rotation of the driving wheel 40 of the four-wheel skateboard 1, the controller 30 controls the motor to start to drive the four-wheel skateboard 1 to slide. If there is no continuous load-assisted drive, the motor in the four-wheeled slide board 1 will stop driving the four-wheeled slide board 1 after a certain distance of sliding of the four-wheeled slide board 1. In order to keep the four-wheel skateboard 1 sliding continuously, continuous load-assisted drive is required. Thus, sliding the same distance as conventional four-wheel skateboards, the four-wheel skateboard 1 of the disclosure needs less power of the power supply 20 to drive the motor, and the number of the needed lithium ion battery 21 in the power supply 20 is not as much as conventional four-wheel skateboards.

The continuous sliding of the four-wheel skateboard 1 is achieved as follows: the four-wheel skateboard 1 is alternately driven by the load and by the motor.

S104. Taking the load off from the induction switch 10 of the four-wheel skateboard 1, the induction switch shuts down the power switch of the four-wheel skateboard 1, and then the four-wheel skateboard 1 is in the power off state.

The four-wheel skateboard 1 can be further controlled by a remote which can be used to speed up or brake the four-wheel skateboard 1 after the four-wheel skateboard 1 is started by a load-assisted drive.

Preferably, the control and starting mode of the motor by the controller of the four-wheel skateboard is as follows: when the four-wheel skateboard 1 is driven by the load to slide, the driving wheel 40, in which the motor is built-in, of the four-wheel skateboard 1 rotates with the four-wheel skateboard 1, the controller 30 detects the rotation of the driving wheel 40 and controls the motor to start to speed up the four-wheel skateboard 1 to thereby slide continuously.

In the embodiment, the controller detects the rotation of the driving wheel 40 and then controls the motor to drive the four-wheel skateboard to slide for between 5 and 100 seconds.

Preferably, the controller detects the rotation of the driving wheel and then controls the motor to drive the four-wheel skateboard to slide for between 10 and 20 seconds.

In this embodiment, after the four-wheel skateboard 1 is driven by the load, the four-wheel skateboard 1 acquires the initial velocity and starts to slide, or the sliding speed of the four-wheel skateboard 1 is increased. When the controller 30 detects that the sliding speed of the four-wheel skateboard 1 is faster than the previous sliding speed, the controller 30 will control the motor to restart, and the controller 30 will start timing the operating time of the motor again. When the speed of the four-wheel skateboard 1 reaches the limit speed of the four-wheel skateboard 1, the motor starts to brake.

The disclosure also provides a four-wheel skateboard 1 controlled by the aforesaid method, which comprises a pedal 50, a driving wheel 40, driven wheels 60, an induction switch 10, a power supply 20, a controller 30, a remote, and a motor. The induction switch 10, the power supply 20, and the motor 30 are electrically connected to the controller 30. The pedal 50 comprises a pedal surface 51; the induction switch 10 is embedded in the pedal 50 from the pedal surface 51; the power supply 20 and the controller 30 are disposed in the pedal 50; the driving wheel 40 and the driven wheels 60 are arranged at a bottom of the pedal 50; the motor is disposed in the driving wheel 40; the remote is in communication with the controller 30 for accelerating or braking the four-wheel skateboard 1 in a certain distance.

Preferably, the pedal 50 comprises a bottom shell 52 and a cover plate 53 mounted on and cooperating with the bottom shell 52 to form an inner cavity; the driving wheel 40 and the driven wheels 60 are arranged on the bottom of the bottom shell 52; the controller 30 and the power supply 20 are disposed in the inner cavity, in order to prevent the dust and moisture from damaging the controller 30 and the power supply 20; the cover plate 53 comprises a first surface away from the bottom shell 52 and a second surface facing the bottom shell, and the first surface acts as the pedal surface 51.

Specifically, the four-wheel skateboard 1 applies one driving wheel 40, one motor, and three driven wheels 60; the motor is installed in the drive wheel 40 and is integrated with the drive wheel 40; two of the three driven wheels 60 are disposed on the front end of the pedal 50, and the driving wheel 40 and the last one driven wheel 60 are disposed on the rear end of the pedal 50.

Preferably, the three driven wheels 60 comprise a first driven wheel 61, a second driven wheel 62, and a third driven wheel 63. The first driven wheel 61 and the third driven wheel 62 are disposed on the front end of the pedal 50 via a first bridge frame 70; the third driven wheel 63 and the driving wheel 40 are disposed on the rear end of the pedal 50 via a second bridge frame 70. The two bridge frames 70 are fixed on the lower part of the pedal 50 by screws.

In this embodiment, the power supply 20 comprises a plurality of 3.7 V lithium-ion batteries 21 connected in series. Because the four-wheel skateboard 1 is driven by the load assistance and the motor, the four-wheel skateboard 1 runs at a low speed and requires only 12 V voltage. Therefore, specifically, the power supply 20 only needs three 3.7 V lithium-ion batteries 21 in series.

In summary, through the load-assisted driving, the controller 30 in the four-wheel skateboard 1 controls the motor to start, and the motor acquires an initial speed to drive the four-wheel skateboard 1 to slide. The four-wheel skateboard 1 relies on the load-assisted driving, not entirely on the driving force of the motor, so that the four-wheel skateboard 1 consumes less electricity for sliding the same distance as conventional four-wheel skateboards, requires relatively small amounts of lithium-ion batteries 21 in the power supply 20, does not require too large battery capacity and too high voltage, and no body sense is involved, thus reducing the manufacturing cost of the four-wheel skateboard 1.

The above embodiments are only the preferred embodiments of the present disclosure, and do not limit the scope of the present disclosure. A person skilled in the art may make various other corresponding changes and deformations based on the described technical solutions and concepts. And all such changes and deformations shall also fall within the scope of the present disclosure.

What is claimed is:

1. A method of controlling a four-wheel skateboard, the method comprising:

applying a load on an induction switch of the four-wheel skateboard by a foot stepping on the four-wheel skateboard, the induction switch starting a power switch of the four-wheel skateboard;

driving the four-wheel skateboard to slide by the load, so that the four-wheel skateboard acquires an initial velocity;

starting a motor by a controller of the four-wheel skateboard, so the controller controls the motor to drive the four-wheel skateboard to slide; and taking the load off from the induction switch of the four-wheel skateboard by removing the foot off the four-wheel skateboard and shutting down the power switch of the four-wheel skateboard by the induction switch.

2. The method of claim 1, wherein starting the motor to drive the four-wheel skateboard to slide comprises: when the load drives the four-wheel skateboard to slide, a driving wheel, in which the motor is built-in, of the four-wheel skateboard rotates with the four-wheel skateboard, the controller detects the rotation of the driving wheel and controls the motor to drive the four-wheel skateboard to slide.

3. The method of claim 2, wherein the controller detects the rotation of the driving wheel and controls the motor to drive the four-wheel skateboard to slide for between 5 and 100 seconds.

4. The method of claim 3, wherein the controller detects the rotation of the driving wheel and controls the motor to drive the four-wheel skateboard to slide for between 10 and 20 seconds.

5. The method of claim 1, wherein a continuous sliding of the four-wheel skateboard is achieved as follows: the four-wheel skateboard is alternately driven by the load and by the motor.

6. The method of claim 1, wherein the method further comprises speeding up or braking the four-wheel skateboard by a remote.

7. A four-wheel skateboard controlled by the method of claim 1, comprising a pedal, a driving wheel, driven wheels, an induction switch, a power supply, a controller, and a motor, wherein the induction switch, the power supply, and the motor are electrically connected to the controller; the pedal comprises a pedal surface; the induction switch is embedded in the pedal from the pedal surface; the power supply and the controller are disposed in the pedal; the driving wheel and the driven wheels are arranged at a bottom of the pedal; the motor is disposed in the driving wheel.

8. The four-wheel skateboard of claim 7, wherein the pedal comprises a bottom shell and a cover plate mounted on and cooperating with the bottom shell to form an inner cavity; the driving wheel and the driven wheels are arranged on a bottom of the bottom shell; the controller and the power supply are disposed in the inner cavity; the cover plate comprises a first surface away from the bottom shell and a second surface facing the bottom shell, and the first surface acts as the pedal surface.

9. The four-wheel skateboard of claim 8, wherein the four-wheel skateboard applies one driving wheel, one motor, and three driven wheels; two of the three driven wheels are disposed on a front end of the pedal, and the one driving wheel and one driven wheel are disposed on a rear end of the pedal.

10. The four-wheel skateboard of claim 9, wherein the three driven wheels comprises a first driven wheel, a second driven wheel, and a third driven wheel; the first driven wheel and the third driven wheel are disposed on the front end of the pedal via a first bridge frame; the one driving wheel and the third driven wheel are disposed on the rear end of the pedal via a second bridge frame.

11. The four-wheel skateboard of claim 10, wherein the power supply comprises a plurality of 3.7 V lithium-ion batteries connected in series.

12. The four-wheel skateboard of claim 7, further comprising a remote in communication with the controller for speeding up or braking the four-wheel skateboard.

* * * * *